US012171310B2

(12) United States Patent
Inukai et al.

(10) Patent No.: US 12,171,310 B2
(45) Date of Patent: Dec. 24, 2024

(54) SLIDE FASTENER

(71) Applicant: YKK Corporation, Tokyo (JP)

(72) Inventors: Takayuki Inukai, Toyama (JP); Jun Shitaka, Toyama (JP); Kentaro Mori, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 18/274,300

(22) PCT Filed: Feb. 12, 2021

(86) PCT No.: PCT/JP2021/005347
§ 371 (c)(1),
(2) Date: Jul. 26, 2023

(87) PCT Pub. No.: WO2022/172414
PCT Pub. Date: Aug. 18, 2022

(65) Prior Publication Data
US 2024/0090628 A1 Mar. 21, 2024

(51) Int. Cl.
*A44B 19/38* (2006.01)
*A44B 19/34* (2006.01)

(52) U.S. Cl.
CPC ..... *A44B 19/38* (2013.01); *A44B 19/34* (2013.01)

(58) Field of Classification Search
CPC ..... A44B 19/38; A44B 19/34; A44B 19/26; A44B 19/36; Y10T 24/2598
See application file for complete search history.

(56) References Cited

U.S. PATENT DOCUMENTS 1,910,404 A * 5/1933 Prentice ..... A44B 19/36 24/436
1,960,202 A * 5/1934 Carr ..... A44B 19/36 24/436
6,634,066 B2 * 10/2003 Okada ..... A44B 19/386 24/433
7,774,906 B2 * 8/2010 Takazawa ..... A44B 19/386 24/433
8,806,725 B2 * 8/2014 Keyaki ..... A44B 19/382 24/433
10,016,025 B1 * 7/2018 Lin ..... A44B 19/24
2002/0116798 A1 8/2002 Okada et al.
(Continued)

FOREIGN PATENT DOCUMENTS

JP 48-40085 Y1 11/1973
JP H02-239804 A 9/1990
(Continued)

OTHER PUBLICATIONS

International Search Report (with translation) and Written Opinion received in corresponding International Application No. PCT/JP2021/005347, mailed Apr. 13, 2021, in 10 pages.

*Primary Examiner* — Robert Sandy
*Assistant Examiner* — Louis A Mercado
(74) *Attorney, Agent, or Firm* — Procopio, Cory, Hargreaves & Savitch LLP

(57) ABSTRACT

The front stop is oriented, when the slider is prevented from moving forward by the stop portion of the front stop, to allow a contact portion in the front region of its second side surface to touch an inner wall surface of the flange of the slider and to allow at least a part of the rear region of its first side surface to touch a wall surface of the interconnection pillar.

17 Claims, 10 Drawing Sheets

(56) References Cited

U.S. PATENT DOCUMENTS

| | | | | |
|---|---|---|---|---|
| 2005/0060847 | A1 | 3/2005 | Himi et al. | |
| 2005/0060848 | A1* | 3/2005 | Tsaur | A44B 19/36 24/436 |
| 2006/0282998 | A1* | 12/2006 | Kusayama | A44B 19/382 24/434 |
| 2008/0196219 | A1* | 8/2008 | Holloway | A44B 19/36 24/436 |
| 2009/0094805 | A1* | 4/2009 | Keyaki | A44B 19/388 24/433 |
| 2012/0124788 | A1* | 5/2012 | Keyaki | A44B 19/388 24/386 |
| 2012/0167354 | A1* | 7/2012 | Keyaki | A44B 19/388 24/386 |
| 2024/0000199 | A1* | 1/2024 | Chayahara | A44B 19/36 |

FOREIGN PATENT DOCUMENTS

| | | | |
|---|---|---|---|
| JP | 2002-253307 | A | 9/2002 |
| JP | 2005-111248 | A | 4/2005 |
| JP | 2014/067654 | A2 | 5/2014 |
| WO | 2017/104007 | A1 | 6/2017 |

* cited by examiner

[Fig. 1]
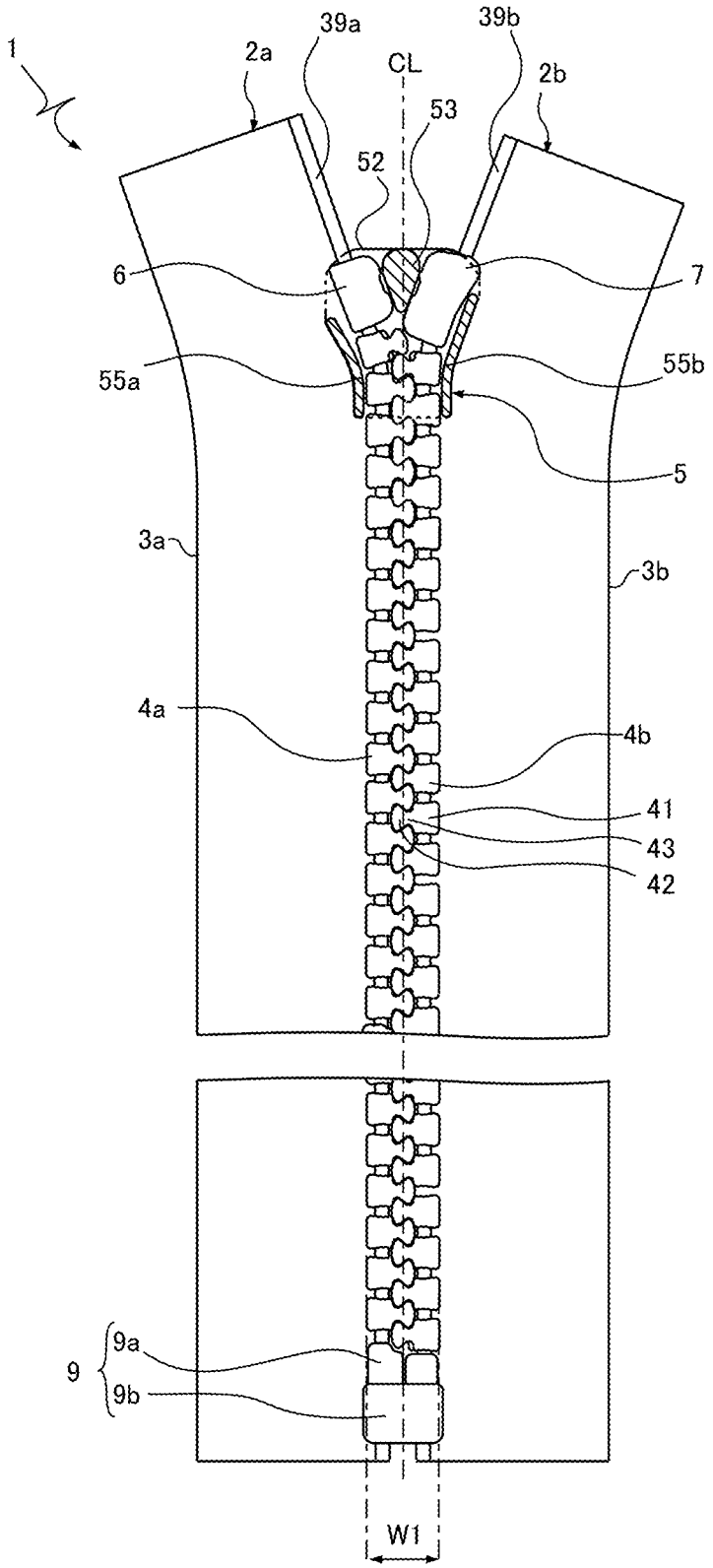

[Fig. 2]
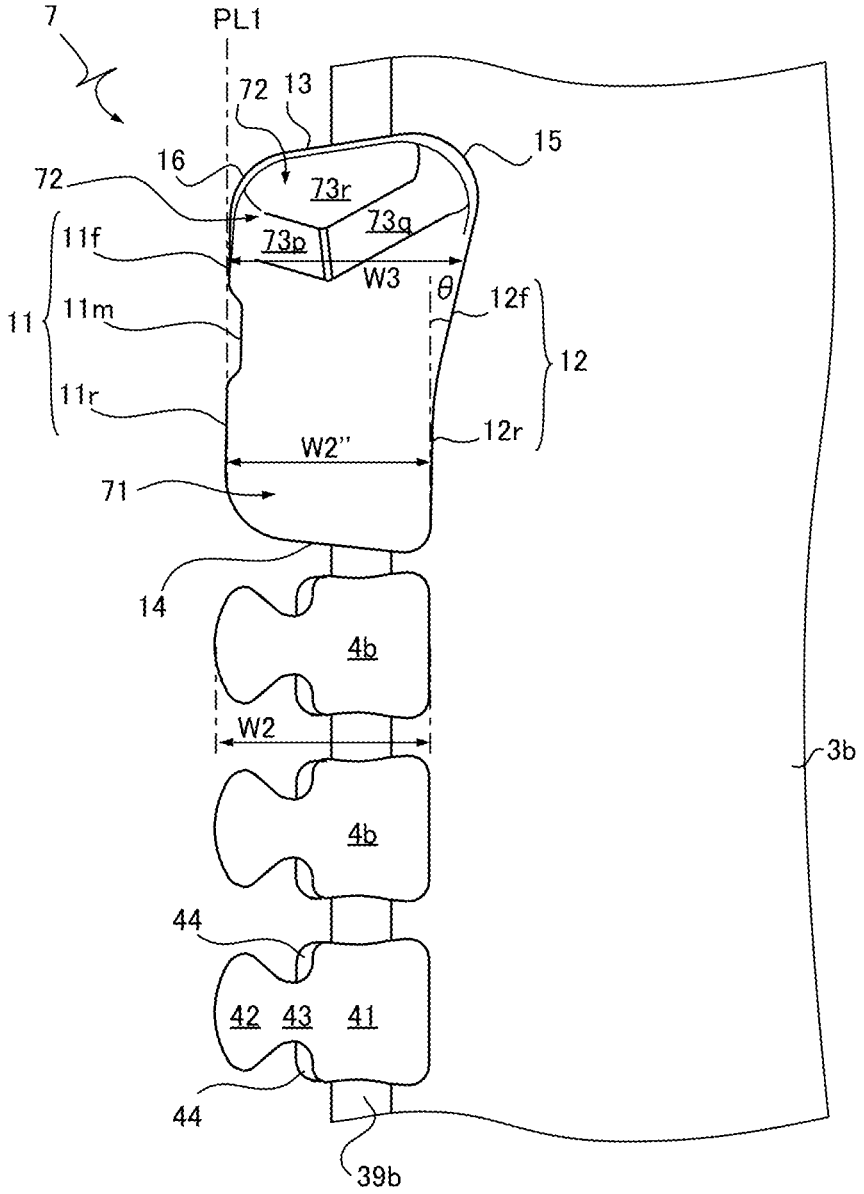

[Fig. 3]
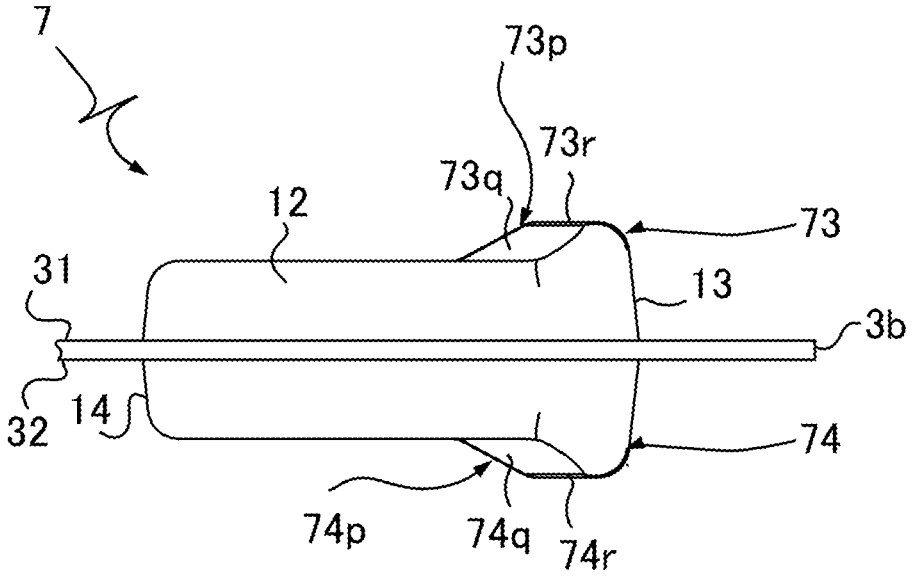
[Fig. 4]
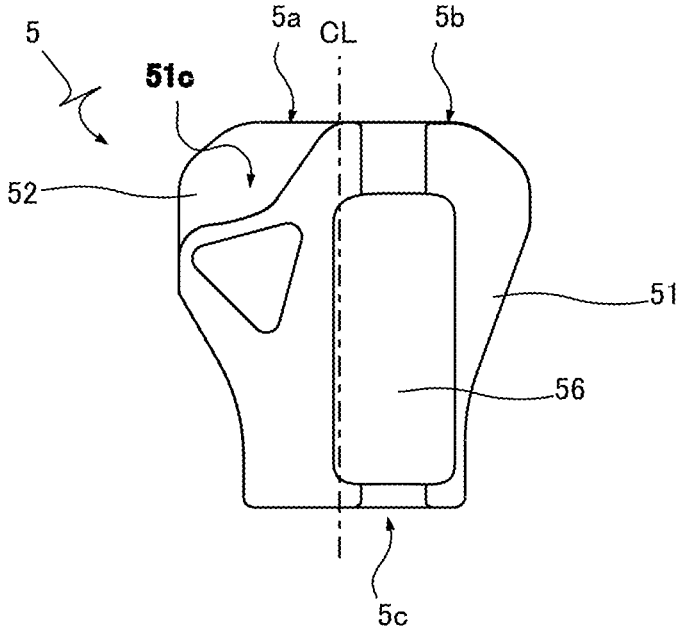

[Fig. 5]
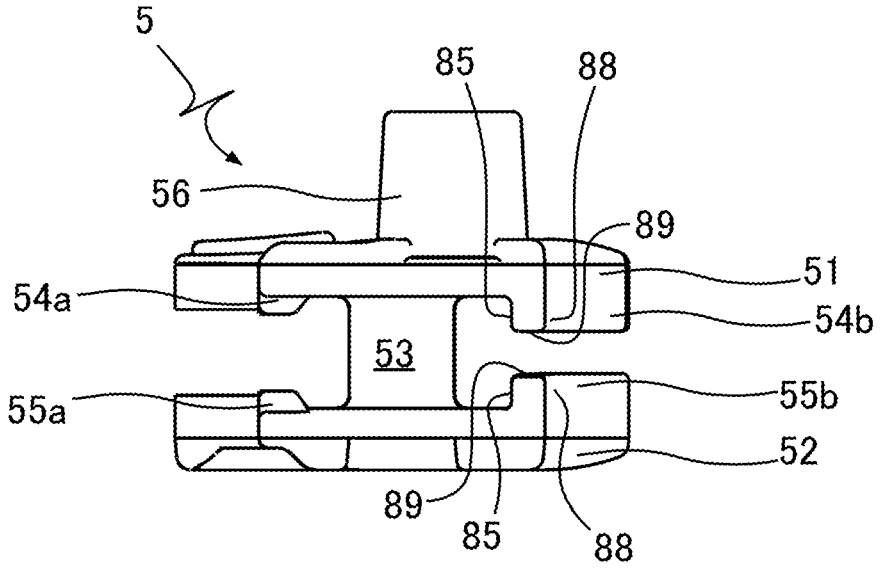
[Fig. 6]
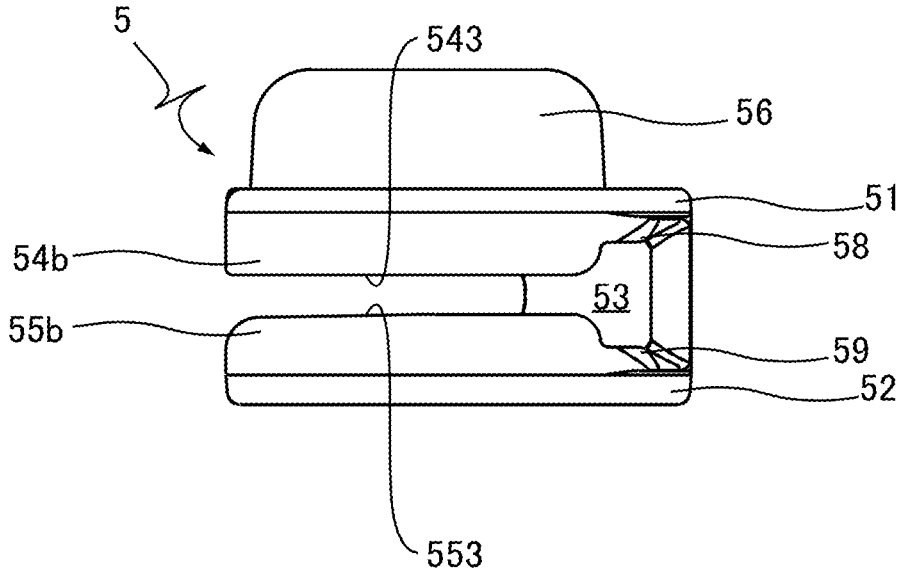

[Fig. 7]
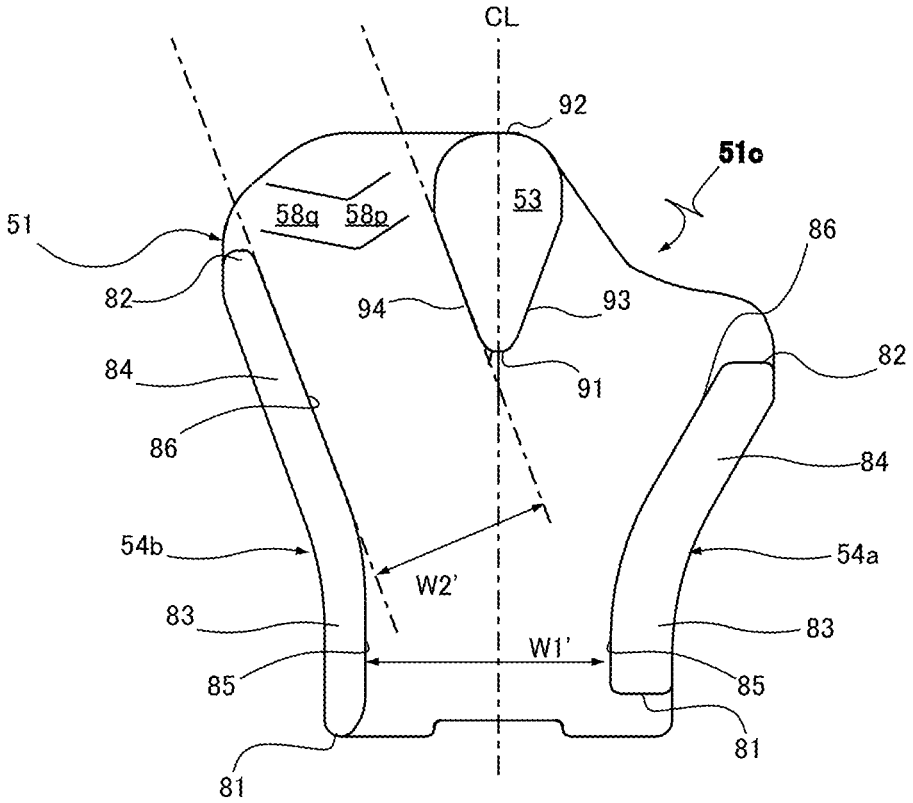

[Fig. 8]
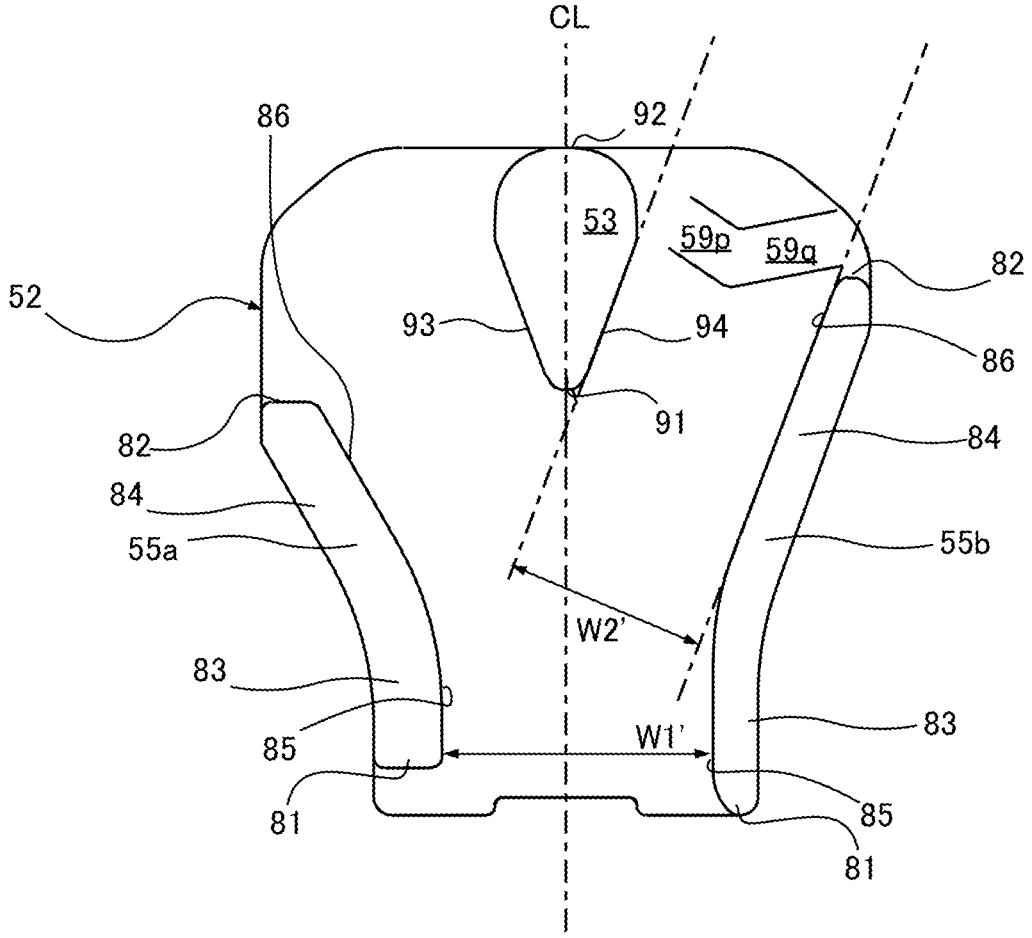

[Fig. 9]
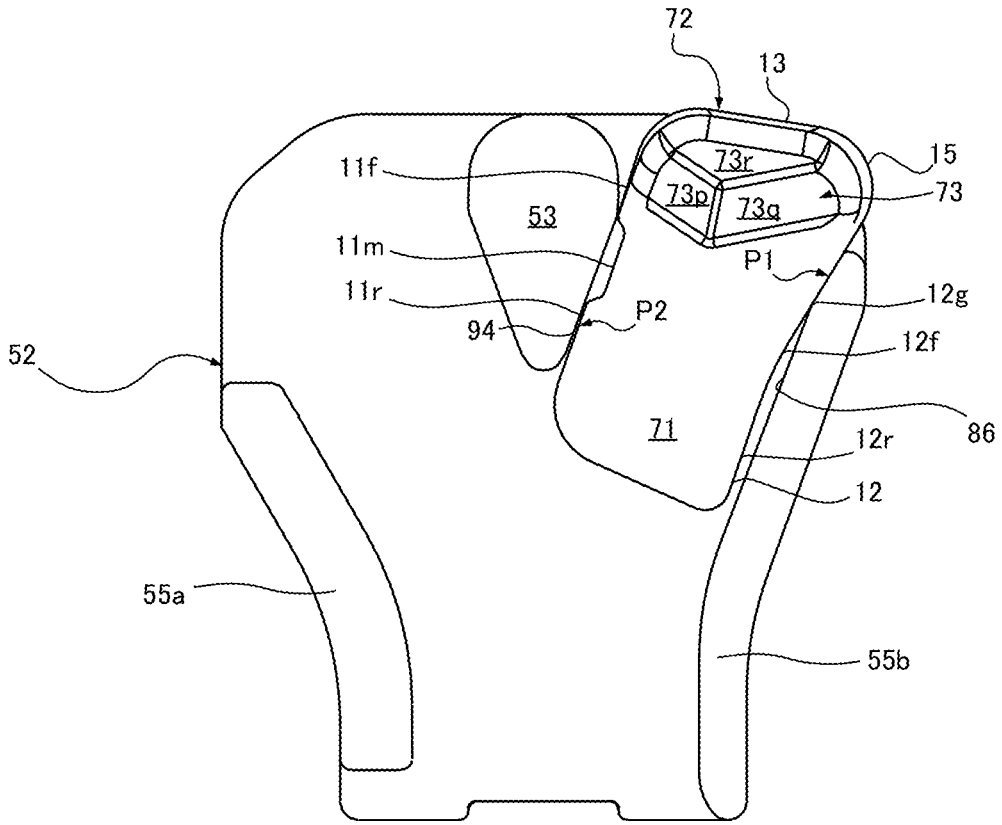
[Fig. 10]
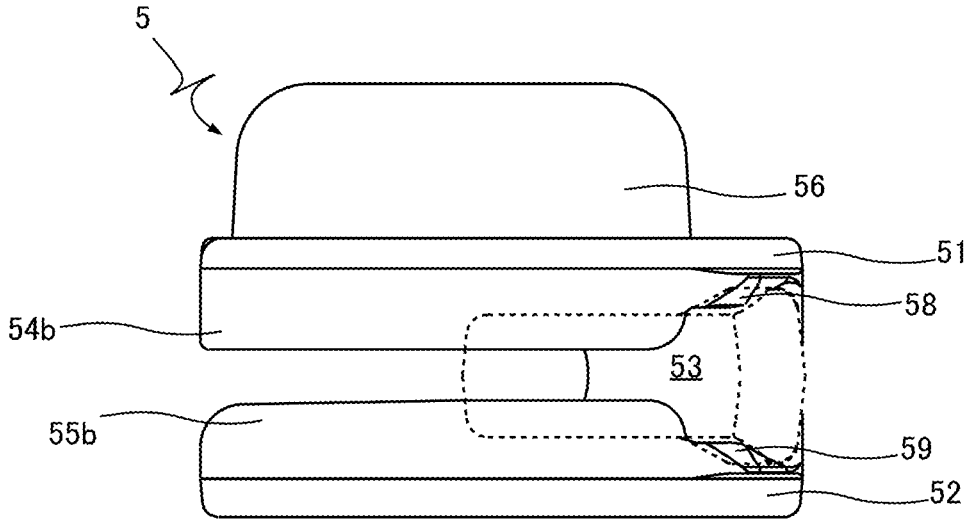

[Fig. 11]
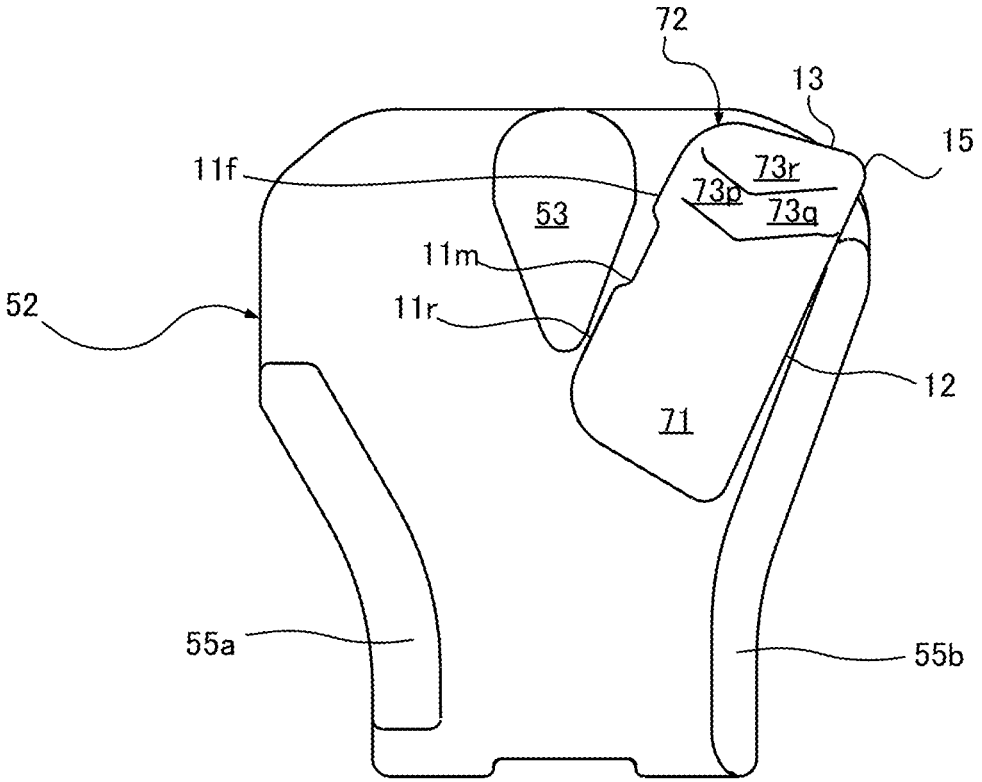
[Fig. 12]
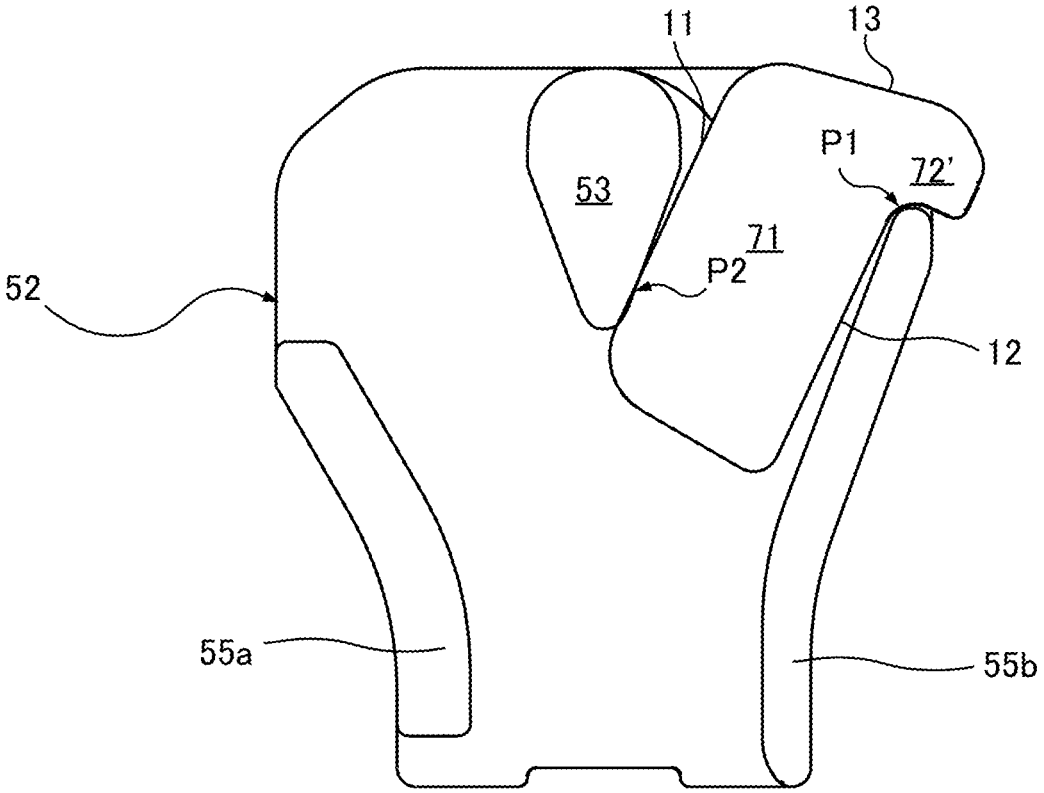

[Fig. 13]
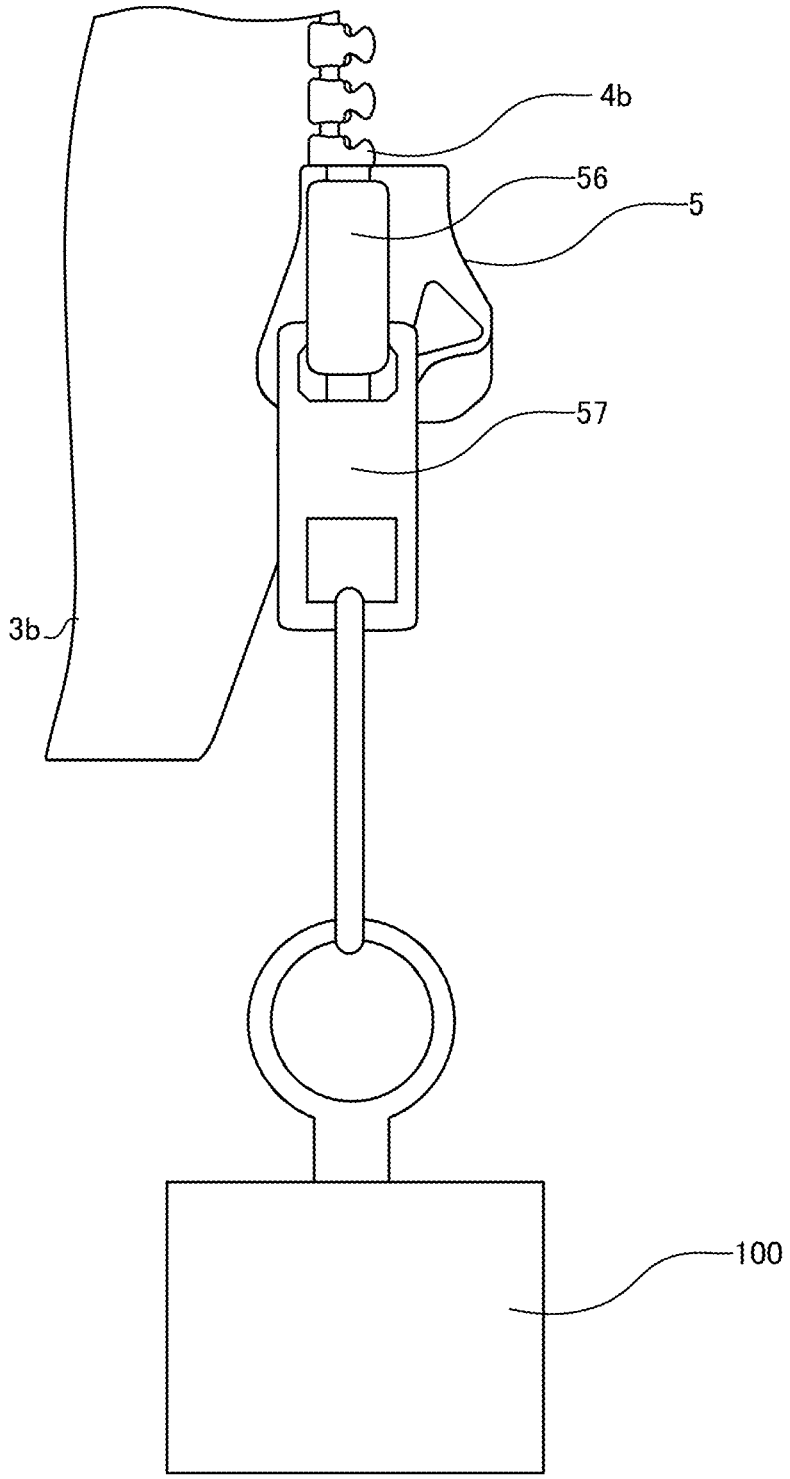

[Fig. 14]
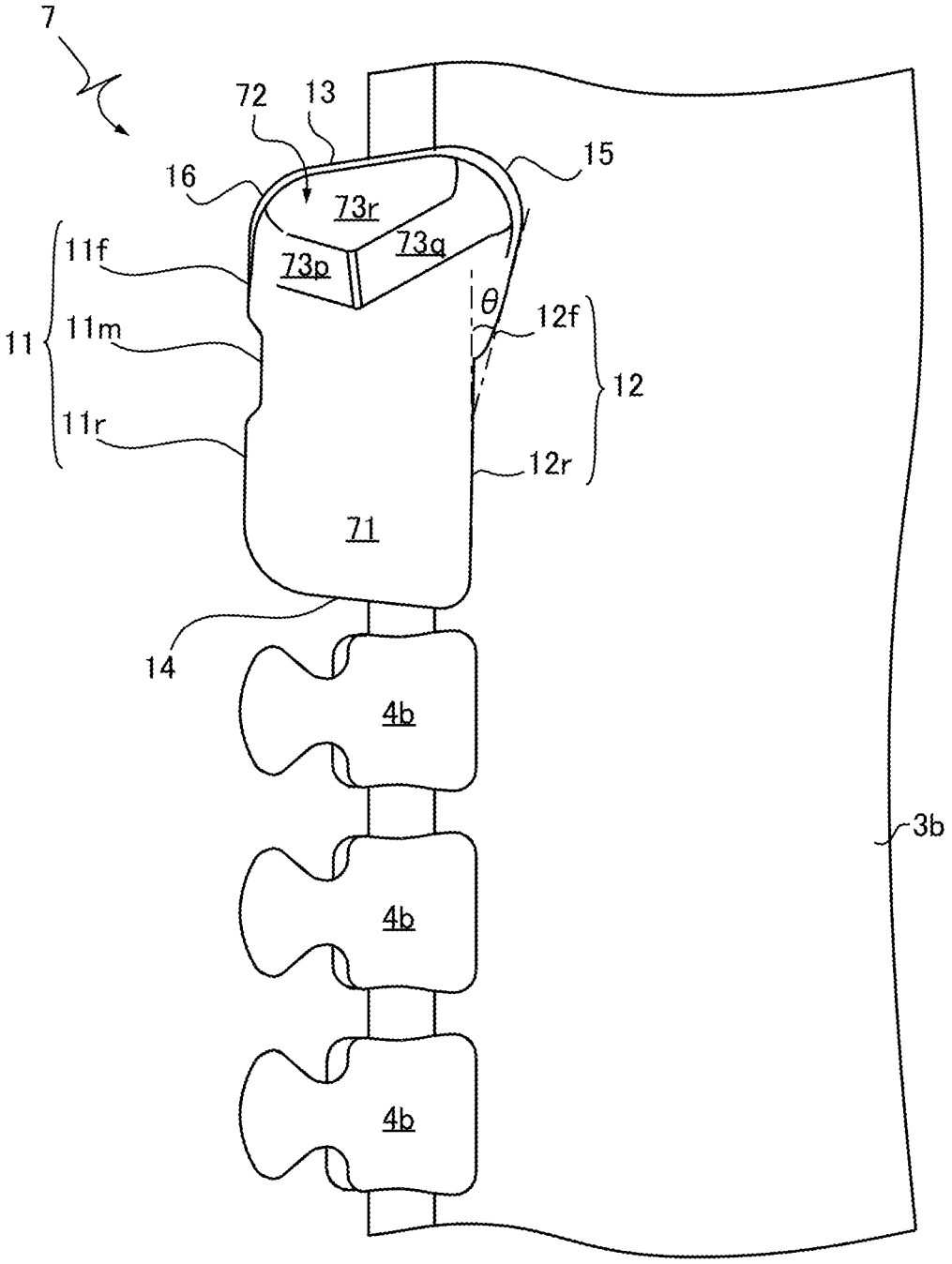

SLIDE FASTENER

CROSS-REFERENCE TO RELATED APPLICATIONS

The present invention is a US national stage application of International Application PCT/JP2021/005347, filed Feb. 12, 2021, the entire content of which is incorporated herein by reference.

TECHNICAL FIELD

The present disclosure is related to slide fastener.

BACKGROUND ART

In slide fasteners, a slider moves forward and rearward to engage and disengage respective fastener elements of left and right fastener stringers. Front stop with upper and lower bulged portions elongated in a width direction to cross a core cord is known in slide fastener as disclosed in Patent literature 1 (See FIG. 1 of Patent literature 1). Rear stop capable of separating left and right fastener stringers is known in slide fastener as disclosed in Patent literature 2 (See FIG. 1 of Patent literature 2). Note that the front stop in Patent literature 2 is made of metal and is provided with projections at both upper and lower sides (See FIG. 6 of Patent literature 2).

Patent literature 3 discloses a slide fastener capable of separating left and right fastener stringers likewise Patent literature 2. In Patent literature 3, a slider can move forward across a front stop of a single stringer, i.e., the slider is detachable from the single stringer, unlike Patent literature 2. For this purpose, a slider is operated to turn from a state of FIG. 3A to a state of FIG. 3B and in turn to a state of FIG. 3C in Patent literature 3. FIGS. 4A-4C of Patent literature 3 discloses steps for attaching the slider to the single stringer.

CITATION LIST

Patent literature

[Patent literature1] International Publication No. 2017/104007

[Patent literature2] Japanese Patent Application Laid-open No. 2002-253307

[Patent literature3] Japanese Patent Application Laid-open No. 2-239804

SUMMARY

Technical Problem

It would be desirable to surely prevent a slider from moving across a front stop of a single stringer and falling from it. For this purpose, in some instances, a test may be done where a weight 100 is attached to a pull tab 57 of a slider 5 as illustrated in FIG. 13 for pulling the slider forward, i.e., vertically downward. In instances where such a test is performed, the present inventors have newly identified a possibility that a greater force may be locally applied to a slider depending on a particular shape of front stop of single stringer.

Solution to Problem

Slide fastener according to an aspect of the present disclosure includes a pair of fastener stringers in which fastener elements are arranged on opposing side edges of fastener tapes; and a slider that moves forward and rearward to engage and disengage the respective fastener elements of the pair of fastener stringers. At least one fastener stringer of the pair of fastener stringers includes a resin-made front stop arranged adjacently to the fastener element of said at least one fastener stringer. The front stop includes: an insert inserted into the slider; a stop portion with upper and lower protrusions respectively protruded upward and downward so as to block forward movement of the slider; a first side surface positioned at a side of an interconnection pillar of the slider in a condition where forward movement of the slider is blocked by the stop portion; and a second side surface positioned at a side of a flange of the slider in a condition where forward movement of the slider is blocked by the stop portion. Each of the first and second side surfaces includes at least a rear region and a front region positioned at a front side relative to the rear region. The front region of the second side surface is inclined or bulged away from the first side surface as extending forward to form a predetermined angle (e.g. an angle in a range between 5° and 20°, not necessarily limited thereto though) with the rear region of the second side surface. The front stop is oriented, when forward movement of the slider is blocked by the stop portion, to allow a contact portion included in the front region of the second side surface to touch an inner wall surface of the flange and to allow at least a part of the rear region of the first side surface to touch a wall surface of the interconnection pillar.

In some embodiments, the front region of the second side surface is an inclined surface that is inclined as described above. The slider may be made of resin, not necessarily limited thereto though.

In some embodiments, the front stop has a front surface and a chamfered corner situated between the front surface and the second side surface. The corner may be positioned in front of the flange with an interspace when forward movement of the slider is blocked by the stop portion. The first side surface may touch the wall surface of the interconnection pillar in its rear region and additionally in a part of its front region, as the contact portion touches the inner wall surface of the flange.

In some embodiments, the rear region of the second side surface may be a flat surface extending parallel to a longitudinal direction of said at least one fastener stringer, but not necessarily limited thereto. Similarly, the rear region of the first side surface may include a flat surface extending parallel to a longitudinal direction of said at least one fastener stringer.

In some embodiments, the interconnection pillar has a left and right wall surfaces that approach each other as extending toward a rear end of the interconnection pillar, the wall surface being touched by said at least a part of the rear region of the first side surface.

In some embodiments, the upper protrusion has a sloped surface that touches a sloped surface facing forward and formed in a lower surface of the upper wing of the slider, and the lower protrusion has a sloped surface that touches a sloped surface facing forward and formed in an upper surface of the lower wing of the slider.

In slide fasteners according to any one of the above described embodiments, achieved is that a condition, in which the slider is pulled forward with a force equal to or greater that 66 N and is prevented from moving forward by the front stop while the pair of fastener stringers are separate, continues for a given duration of at least 10 seconds.

Advantageous Effects of Invention

According to an aspect of the present disclosure, application of greater force from one to the other between a front stop of single stringer and a slider would be suppressed.

BRIEF DESCRIPTION OF DRAWINGS

FIG. 1 is an elevational view of slide fastener according to an aspect of the present disclosure, schematically illustrating a condition where a front stop blocks forward movement of a slider.

FIG. 2 is a partial schematic view illustrating a front end section of right single stringer of slide fastener according to an aspect of the present disclosure.

FIG. 3 is a schematic view illustrating a right side surface of a front stop of the single stringer illustrated in FIG. 2.

FIG. 4 is a schematic top view of a slider.

FIG. 5 is a schematic rear view of the slider.

FIG. 6 is a schematic right-side view of the slider.

FIG. 7 is a schematic lower side view of upper wing of the slider.

FIG. 8 is a schematic upper side view of lower wing of the slider.

FIG. 9 is a schematic view illustrating a state where a front stop has been inserted in the slider and retained by the slider on the single right stringer.

FIG. 10 is a schematic right-side view of the slider where a dotted line indicates a front stop inserted in and retained by the slider.

FIG. 11 is a schematic view of a comparative example illustrating a state where a front stop is inserted in and retained by a slider on a single stringer.

FIG. 12 is a schematic view of another comparative example illustrating a state where a front stop is inserted in and retained by a slider on a single stringer.

FIG. 13 is a reference diagram referred to demonstrate a test for evaluating a stopping capability of front stop.

FIG. 14 is a partial schematic view illustrating a front end section of right single stringer of slide fastener according to another aspect of the present disclosure.

DESCRIPTION OF EMBODIMENTS

Hereinafter, various embodiments and features would be discussed with reference to FIGS. 1-14. A skilled person would be able to combine respective embodiments and/or respective features without requiring excess description, and would appreciate synergistic effects of such combinations. Overlapping description among the embodiments are basically omitted. Referenced drawings aim mainly for describing inventions and are simplified for the sake of convenience of illustration. The respective features should be appreciated as universal features not only effective to a slide fastener presently disclosed but also effective to other various slide fasteners not disclosed in the present specification.

In the present specification, Front-rear direction would be understood based on a direction of movement of slider. Left-right direction is orthogonal to the front-rear direction and parallel to a tape surface defining a thickness of fastener tape. Up-down direction is orthogonal to the front-rear direction and the left-right direction. Note that these terms of direction can be redefined based on the following descriptions.

Slide fastener 1 has a pair of left and right fastener stringers 2*a*, 2*b* in which left and right fastener elements 4*a*, 4*b* are arranged on opposing side edges 39*a*, 39*b* of the left and right fastener tapes 3*a*, 3*b*; a slider 5 that moves forward and rearward to engage and disengage the left and right fastener elements 4*a*, 4*b* of those left and right fastener stringers 2*a*, 2*b*; and a rear stop 9. Note that the slider 5 moves forward and rearward along a central line CL of the slide fastener 1. Also, the fastener stringer 2*a*, 2*b* and the fastener tape 3*a*, 3*b* have a longitudinal direction that matches the front-rear direction, and a width direction of the fastener stringer 2*a*, 2*b* and the fastener tape 3*a*, 3*b* matches the left-right direction.

The left fastener stringer 2*a* has, additionally to the fastener tape 3*a* and the fastener element 4*a*, a resin-made left front stop 6 that is arranged adjacently to the fastener element 4*a*. Similarly, the right fastener stringer 2*b* has, additionally to the fastener tape 3*b* and the fastener element 4*b*, a resin-made right front stop 7 that is arranged adjacently to the fastener element 4*b*. The forward movement of the slider 5 may be blocked by the left and right front stops 6 and 7 but should not be limited to this, and may be blocked by the front stop 7 alone. That is, the slider 5 may be prevented by the front stop 7 alone from falling off the right fastener stringer 2*b* even in a situation where the left and right fastener stringers 2*a* and 2*b* are separate and the slider 5 is moved over the fastener element 4*b* (e.g. a line of fastener elements 4*b*) thereof. Configuration of the front stop 7 will be discussed in detail hereinafter.

The rear stop 9 is configured to allow separation of the left and right fastener stringers 2*a* and 2*b*. In some implementations, the rear stop 9 has a bar (first portion) 9*a* and a box (second portion) 9*b* which are configured to be separable to the left and right sides. The box 9*b* has a box body and a box bar extending forward from the box body. In order to couple the left and right fastener stringers 2*a* and 2*b*, the bar 9*a* is inserted through the inside of the slider 5 positioned adjacently in front of the box body of the box 9*b* and into an insertion groove of the box body of the box 9*b*. In this condition, the slider 5 is moved forward to couple the bar 9*a* and the box 9*b*. In order to separate the left and right fastener stringers 2*a* and 2*b*, the slider 5 is positioned adjacently in front of the box 9*b*, and the bar 9*a* is drawn forward out of the insertion groove of the box body of the box 9*b* and through the inside of the slider 5. Note that various types are available for a rear stop 9 and should not be limited to this illustrated example.

The fastener tape 3*a*, 3*b* is a flexible member having a thickness defined by a tape top surface 31 and a tape bottom surface 32 (See FIG. 3), and typically is a woven fabric or knitted fabric or mixture of the two. The fastener tape 3*a*, 3*b* is elongated in the front-rear direction with a constant width in the left-right direction. The side-edge 39*a*, 39*b* of the fastener tape 3*a*, 3*b* is provided with a core cord to which the fastener element 4*a*, 4*b* and the front stop 6, 7 are secured.

The fastener elements 4*a*, 4*b* are resin-made elements of resin adhering, through injection-molding, to the opposing side edges 39*a*, 39*b* (the core cord) of the fastener tapes. The fastener elements 4*a*, 4*b* are arranged at a constant pitch in the front-rear direction to configure a line of elements. The left and right fastener elements 4*a* and 4*b* are arranged alternately along the front-rear direction so as to effect the engagement and disengagement of them.

The resin-made element has a base 41 adhering to the side-edge of the fastener tape, a head 42 arranged outwardly of fastener tape than the base 41, and a neck 43 interposed between the base 41 and the head 42. The neck 43 has a narrower width than a width of the head 42 in the front-rear direction. The head 42 of the fastener element 4*a* can be inserted and retained between the necks 43 of the fastener elements 4*b* which are adjacent in the front-rear direction. Note that outwardly of fastener tape indicates a direction directed from a position on a tape surface of a fastener tape to a position outside of the tape surface. Optionally, the neck 43 is provided with fin portions 44 at its both front and rear sides (See FIG. 2) and the head 42 is provided with an insertion groove into which the fins 44 are inserted.

Note that the fastener element 4*a*, 4*b* may be other types of element such as a metal-made element, ceramics-made element or coil-like element. The metal-made element would be one widely known. The ceramics-made element includes ceramics at least partially and is attached to an opposing side edge of a fastener tape by a suitable method. The coil-like element would be one widely known and has a helically wound monofilament sewn to a fastener tape by thread(s).

The slider 5 may be made of resin, metal or ceramics and as illustrated in FIGS. 4-6, has an upper wing 51, a lower wing 52, an interconnection pillar 53 interconnecting the upper wing 51 and the lower wing 52, left and right flanges 54*a* and 54*b* protruded downward from left and right side-edges of the upper wing 51, left and right flanges 55*a* and 55*b* protruded upward from left and right side-edges of the lower wing 52 and a pull-tab attachment portion 56. The upper and lower wings 51 and 52 are interconnected by the interconnection pillar 53 at the center of their front end portions in the left-right direction to form a Y-shaped element passage, and the left and right flanges 54*a*, 54*b*, 55*a*, 55*b* are arranged to prevent the fastener element 4*a*, 4*b* from deviating from the Y-shaped element passage.

In response to application of laterally pulling force equal to or over a threshold to the left and right fastener stringers 2*a* and 2*b*, the slider 5 may be configured to release the one fastener stringer 2*a* off the slider 5. For this purpose, a cutout 51*c* is formed in the front end portion of the upper wing 51 at its left side, and the left flanges 54*a* and 55*a* are sized to be shorter in the front-rear direction and lower in height relative to the right flanges 54*b* and 55*b*. Further, the front end of the left flange 54*a*, 55*a* is located rearward offset relative to the front end of the right flange 54*b*, 55*b*. Still further, the pull-tab attachment portion 56 is arranged offset to a right side or left side relative to a central line CL of the slider 5. Needless to say, the present disclosure is not limited to this kind of slider 5 but can be deployed to any other types of sliders 5.

The lower surface of the upper wing 51 and the upper surface of the lower wing 52 (collectively referred to as opposed inner surfaces) are opposed to have an interspace that is equal to or slightly greater than thicknesses (e.g. maximum thickness) of the fastener element 4*a*, 4*b* and the insert 71 of the front stop 7 described below. The interspace between the opposed inner surfaces of the upper and lower wings 51 and 52 is less than a maximum thickness of the stop portion 72 of the front stop 7 described below. Sloped surfaces 58*p*, 58*q* (which may be referred to as a sloped surface 58 without distinguishing them) facing forward are formed in the lower surface of the upper wing 51. Sloped surfaces 59*p*, 59*q* (which may be referred to as a sloped surface 59 without distinguishing them) facing forward are formed in the upper surface of the lower wing 52. Sloped surfaces 73*p*, 73*q* of the upper protrusion 73 of the front stop 7 described below may be in surface contact with the sloped surfaces 58*p*, 58*q* of the upper wing 51. Similarly, sloped surfaces 74*p*, 74*q* of the lower protrusion 74 of the front stop 7 may be in surface contact with the sloped surfaces 59*p*, 59*q* of the lower wing 52.

As illustrated in FIGS. 7 and 8, each flange 54*a*, 54*b*, 55*a*, 55*b* extends along the central line CL of the slider 5 and has a rear end 81, a front end 82, a rear portion 83 extending from the rear end 81 in parallel to the central line CL of the slider 5, and a front portion 84 slanting away from the central line CL of the slider 5 as extending forward from the rear portion 83. The inner wall surface 85 of the rear portion 83 extend in parallel to the central line CL of the slider 5. The inner wall surface 86 of the front portion 84 slants away from the central line CL of the slider 5 as extending forward. Interspace W1' between the left and right flanges 54*a*, 54*b* or between the inner wall surfaces 85 of the rear portions 83 of the left and right flanges 55*a*, 55*b* is equal to or slightly greater than a width W1 of engaged left and right fastener elements 4*a*, 4*b* in the left-right direction (See FIG. 1). Note that the central line CL of the slider 5 is coaxial with the central line CL of the slide fastener 1.

The interconnection pillar 53 extends from its rear end 91 to its front end 92 on the central line CL of the slider 5 and is shaped symmetrically with respect to the central line CL. The interconnection pillar 53 has left and right flat wall surfaces 93 and 94 that approach one another as extending toward the rear end 91. Interspace W2' between the wall surface 93, 94 and the inner wall surface 86 of the front portion 84 of the flange 54*a*, 54*b*, 55*a*, 55*b* is equal to or slightly greater than a width W2 of the respective fastener element 4*a*, 4*b* in the left-right direction (See FIG. 2). Note that, in some implementations, the wall surface 94 and the inner wall surface 86 of the flange 55*b* are oriented in parallel. The same applied to the wall surface 93 and the inner wall surface 86 of the flange 55*a*.

Left and right front mouths 5*a* and 5*b* are arranged at the left and right sides of the interconnection pillar 53, and through these mouths the left and right fastener elements 4*a*, 4*b* can enter and exit the slider 5. Rear mouth 5*c* is provided at the opposite side of the front mouths 5*a* and 5*b* in the front-rear direction, and through the mouth the engaged fastener elements 4*a*, 4*b* can enter and exit the slider 5. As the slider 5 moves forward, the left and right fastener elements 4*a*, 4*b* enter into the slider 5 via the left and right front mouths 5*a*, 5*b* and are engaged one another at a position after passing by the interconnection pillar 53. As the slider 5 moves rearward, the engaged fastener elements 4*a*, 4*b* enter the slider 5 via the rear mouth 5*c*, are divided by the interconnection pillar 53 and in turn exit the slider 5 via the left and right front mouths 5*a*, 5*b*.

Note that each flange 54*a*, 54*b*, 55*a*, 55*b* has an outer wall surface 88 extending in the front-rear direction similar to the inner wall surface 85, 86, and a top surface 89 extending between the inner wall surface 85, 86 and the outer wall surface 88. The flange 54*a* and the flange 55*a* are arranged to be in mirror symmetry and define an insertion space for the fastener tape 3*a* between their top surfaces 89. The same applies to the flange 54*b* and the flange 55*b*.

The front stop 7 has an insert 71 inserted into the slider 5 and a stop portion 72 having upper and lower protrusions 73, 74 respectively protruding upward and downward to block the forward movement of the slider 5. In some implementations including the illustrated example, the insert 71 is a rear portion of the front stop 7 and the stop portion 72 is a front portion of the front stop 7. In some implementations, the width W2" of the insert 71 is less than the interspace W2' between the wall surface 94 and the inner wall surface 86 described above, and is equal to or slightly less than the width W2 of the fastener element 4*b* in the left-right direction. In some implementations, the width W3 of the stop portion 72 is greater than the interspace W2' between the wall surface 94 and the inner wall surface 86 described above and greater than the width W2 of the fastener element 4*b* in the left-right direction.

The upper protrusion 73 has at least one sloped surface (e.g. the left and right sloped surfaces 73*p*, 73*q*) that extends obliquely upward from the upper surface of the insert 71, and the lower protrusion 74 has at least one sloped surface (e.g. the left and right sloped surfaces 74*p*, 74*q*) that extends obliquely downward from the lower surface of the insert 71, not necessarily limited to this though. The sloped surface (e.g. the left and right sloped surfaces 73*p*, 73*q*) of the upper protrusion 73 may be in surface contact with the sloped surface (e.g. the left and right sloped surfaces 58*p*, 58*q*) of the upper wing 51, and the sloped surface (e.g. the left and right sloped surfaces 74*p*, 74*q*) of the lower protrusion 74 may be in surface contact with the sloped surface (e.g. the left and right sloped surfaces 59*p*, 59*q*) of the lower wing 52, thereby ensuring larger contact area therebetween. In some implementations, a maximum angle of the sloped surface relative to the upper or lower surface in the insert 71 is within a range between 20° to 40°, preferably in a range between 25° to 35°.

The sloped surface (e.g. the left and right sloped surfaces 73*p*, 73*q*) of the upper protrusion 73 and the sloped surface (e.g. the left and right sloped surfaces 58*p*, 58*q*) of the upper wing 51 are configured, e.g. V-shaped to draw the front stop 7 into an appropriate position in the slider 5 as the slider 5 moves forward, not necessarily limited to this though. The same applies to the sloped surface (e.g. the left and right sloped surfaces 74*p*, 74*q*) of the lower protrusion 74 and the sloped surface (e.g. the left and right sloped surfaces 59*p*, 59*q*) of the lower wing 52. For example, the left and right sloped surfaces 73*p*, 73*q* slant slightly rearward as extending toward a boundary between the sloped surfaces 73*p* and 73*q*. The same applies to the left and right sloped surfaces 74*p*, 74*q*. The left and right sloped surfaces 58*p*, 58*q* of the upper wing 51 slant slightly rearward as extending toward a boundary between the sloped surfaces 58*p* and 58*q*. The same applies to the left and right sloped surfaces 59*p*, 59*q* of the lower wing 52.

The front stop 7 has first and second side surfaces 11 and 12 extending in the front-rear direction and front and rear surfaces 13 and 14 extending in the left-right direction. The first side surface 11 is situated outwardly of fastener tape relative to the second side surface 12, and is positioned outside of the tape surface of the fastener tape 3*b*. The second side surface 12 is situated inwardly of fastener tape relative to the first side surface 11, and is positioned on the tape surface of the fastener tape 3*b*. In a condition where the forward movement of the slider 5 is blocked by the stop portion 72, the first side surface 11 is positioned at the side of the interconnection pillar 53 of the slider 5 and the second side surface 12 is positioned at the side of the flange 54*b*, 55*b* of the slider 5. Note that the front surface 13 slants slightly rearward as extending outwardly of fastener tape, and the rear surface 14 slants slightly forward as extending outwardly of fastener tape.

The first side surface 11 has a front region 11*f* and a rear region 11*r*. The front region 11*f* is positioned at the front side relative to the rear region 11*r*. A recess 11*m* is interposed between the front region 11*f* and the rear region 11*r*, but can be omitted. The rear region 11*r* and the front region 11*f* are flat surfaces extending in parallel to the longitudinal direction of the fastener stringer 2*b*.

The second side surface 12 has a rear region 12*r* and a front region 12*f* positioned at the front side relative to the rear region 12*r*. The front region 12*f* is inclined away from the first side surface 11 as extending forward so as to form a predetermined angle θ relative to the rear region 12*r*. The predetermined angle θ may be within a range of 5° to 20°, preferably within a range of 10° to 15°. The rear region 12*r* includes a flat surface that extends in parallel to the longitudinal direction of the fastener stringer 2*b*. The rear region 12*r* includes a region oriented parallel to the rear region 11*r*, but not necessarily limited to this.

Note that the width W2" of the front stop 7 defined by the rear region 11*r* and the rear region 12*r* is less than the interspace W2' between the wall surface 94 and the inner wall surface 86 described above, and is equal to or slightly less than the width W2 of the fastener element 4*b* in the left-right direction. The width W3 of the front stop 7 defined by the front region 11*f* (and/or a plane PL1 where the rear region 11*r* exists) and the front region 12*f* increases forward in accordance with the slant of the front region 12*f* so as to be greater than the width W2 of the fastener element 4*b* in the left-right direction and similarly so as to be greater than the interspace W2' between the wall surface 94 of the interconnection pillar 53 and the inner wall surface 86 of the flange 54*b*, 55*b*.

As shown in FIG. 9, when the forward movement of the slider 5 is blocked by the stop portion 72, the front stop 7 is oriented to allow a contact portion (a part of the front region 12*f*) 12*g* included in the front region 12*f* of the second side surface 12 to touch the inner wall surface 86 of the flange 54*b*, 55*b* and to allow at least a part of the rear region 11*r* of the first side surface 11 to touch the wall surface 94 of the interconnection pillar 53. The front stop 7 is in contact with the slider 5 at four (upper, lower, left and right) locations, thus stress caused in the front stop 7 and/or the slider 5 would be dispersed. Moreover, compared with a case (FIG. 12) where the front stop 7 touches the front end 82 of the flange 54*a*, 54*b*, the contact portion 12*g* in the front region 12*f* of the second side surface 12 touches the inner wall surface 86 of the flange 54*b*, 55*b* and thus lesser force would be applied by the rear region 11*r* of the first side surface 11 to the wall surface 94 of the interconnection pillar 53. For example, in cases where the slider 5 is made of plastic, destruction of slider (e.g. formation of crack at an upper or lower end of the interconnection pillar 53 of the slider 5) due to a force locally applied by the front stop 7 to the slider 5 would be avoided or suppressed. Also in cases where the slider 5 is made of metal, local application of greater force from the slider 5 to the resin-made front stop 7 would be avoided or suppressed.

When the forward movement of the slider 5 is blocked by the stop portion 72, the sloped surfaces 73*p*, 73*q* of the upper protrusion 73 of the stop portion 72 are in surface contact with the sloped surfaces 58*p*, 58*q* of the upper wing 51, and the sloped surfaces 74*p*, 74*q* of the lower protrusion 74 of the stop portion 72 are in surface contact with the sloped surfaces 59*p*, 59*q* of the lower wing 52, not necessarily limited to this though. In cases where the slider 5 is made of resin, the upper and lower wings 51 and 52 may be pressed by the upper and lower protrusions 73 and 74 of the stop portion 72, enlarging the interspace between the wings 51 and 52 in the up-down direction. In such an instance, a stress may be caused at a connection point between the interconnection pillar 53 and the upper wing 51 and similarly at a connection point between the interconnection pillar 53 and the lower wing 52.

When the forward movement of the slider 5 is blocked by the stop portion 72, the corner 15 of the front stop 7 is positioned in front of the flange 54*b*, 55*b* with an interspace. The front region 12*f* of the second side surface 12 of the front stop 7 can be set to a degree less noticeable compared to the rear region 12*r*, allowing similar appearance of the front stop 7 to conventional ones. If the rear region 11*r* of the first side surface 11 includes a flat surface that extends in parallel to the longitudinal direction of the fastener stringer 2, this flat surface can be in surface contact with the wall surface 94 of the interconnection pillar 53.

When the contact portion 12*g* touches the inner wall surface 86 of the flange 54*b*, 55*b*, the first side surface 11 may touch the wall surface 94 of the interconnection pillar 53 in a part of its front region 11*f* (e.g. an edge between the front region 11*f* and the recess 11*m*) additionally to its rear region 11*r*. This allows increased contact area between the interconnection pillar 53 and the first side surface 11.

In a comparative example illustrated in FIG. 11, the second side surface 12 of the front stop 7 is entirely flat. When performing a test illustrated in FIG. 13, it is likely that the front stop 7 does not touch the slider at its both left and right sides when the forward movement of the slider 5 is blocked by the stop portion 72 of the front stop 7.

In a comparative example illustrated in FIG. 12, a stop portion 72' is provided as an alternative to the above-discussed stop portion 72. In performing a test illustrated in FIG. 13, while the forward movement of the slider 5 has been blocked by the stop portion 72', the stop portion 72' would be in contact with the front end of the flange 55*b*, and the first side surface 11 of the front stop 7 would be in contact with the wall surface of the interconnection pillar 53. Depending on a weight value of the weight 100, a crack may be formed at the upper or lower end of the interconnection pillar 53 as the interconnection pillar 53 is excessively pressed by the first side surface 11 of the front stop 7. In cases where the slider 5 is made of metal, there is a possibility that the front stop 7 is pressed by the slider 5 with excessively greater force (this may affect durability or mechanical strength of the front stop 7).

Compared with FIG. 12, in the present embodiment illustrated in FIG. 9, a distance between a position P1 where the front stop 7 touches the flange 55*b* and a position P2 where the front stop 7 touches the interconnection pillar 53 is reduced. This allows reduction of magnitude of force otherwise applied to the interconnection pillar 53 at the second position P2 with the first position P1 serving as a fulcrum, while the slider is being pulled forward (vertically downward) by the weight 100. In some implementations, a condition can continue over a given duration of at least 10 seconds where the slider 5 has been pulled forward by a force equal to or greater than 66 N and the forward movement of the slider 5 has been blocked by the front stop 7.

As illustrated in FIG. 14, the front region 12*f* of the second side surface 12 can be bulged away from the first side surface 11 as extending forward so as to form a predetermined angle θ relative to the rear region 12*r* of the second side surface 12. The predetermined angle θ is defined between a tangent to the front region 12*f* and a plane where the rear region 12*r* exists. The tangent to the front region 12*f* is determined so as to reduce the predetermined angle θ to its minimum value. Alternatively, if the front region 12*f* includes a flat surface, the tangent would be drawn to be coplanar with a plane where that flat surface exists.

Based on the above teachings, a skilled person in the art would be able to add various modifications to the respective embodiments. Reference codes in Claims are just for reference and should not be referred for the purpose of narrowly construing the scope of claims.

REFERENCE CODES

1 the slide fastener; 2*a*, 2*b* the fastener stringer; 3*a*, 3*b* the fastener tape; 4*a*, 4*b* the fastener element; 5 the slider; 7 the front stop; 11 the first side surface; 11*r* the rear region; 11*f* the front region; 12 the second side surface; 12*r* the rear region; 12*f* the front region; 51 the upper wing; 52 the lower wing; 53 the interconnection pillar; 54*a*, 54*b* the flange; 55*a*, 55*b* the flange; 71 the insert; 72 the stop portion

The invention claimed is:

1. A slide fastener comprising:

a pair of fastener stringers in which fastener elements are arranged on opposing side edges of fastener tapes; and a slider that moves forward and rearward to engage and disengage the respective fastener elements of the pair of fastener stringers, wherein at least one fastener stringer of the pair of fastener stringers comprises a resin-made front stop arranged adjacently to the fastener element of said at least one fastener stringer, the front stop comprising:

an insert inserted into the slider;

a stop portion with upper and lower protrusions respectively protruded upward and downward so as to block forward movement of the slider;

a first side surface positioned at a side of an interconnection pillar of the slider in a condition where forward movement of the slider is blocked by the stop portion; and a second side surface positioned at a side of a flange of the slider in a condition where forward movement of the slider is blocked by the stop portion, each of the first and second side surfaces includes at least a rear region and a front region positioned at a front side relative to the rear region, the front region of the second side surface is inclined or bulged away from the first side surface as extending forward to form a predetermined angle with the rear region of the second side surface, and the front stop is oriented, when forward movement of the slider is blocked by the stop portion, to allow a contact portion included in the front region of the second side surface to touch an inner wall surface of the flange and to allow at least part of the rear region of the first side surface to touch a wall surface of the interconnection pillar.

2. The slide fastener of claim 1, wherein the front region of the second side surface is an inclined surface that is inclined away from the first side surface as extending forward.

3. The slide fastener of claim 1, wherein the rear region of the second side surface is a flat surface extending parallel to a longitudinal direction of said at least one fastener stringer.

4. The slide fastener of claim 1, wherein the predetermined angle is in a range between 5° and 20°.

5. The slide fastener of claim 1, wherein the front stop has a front surface and a chamfered corner situated between the front surface and the second side surface, the corner being positioned in front of the flange with an interspace when forward movement of the slider is blocked by the stop portion.

6. The slide fastener of claim 1, wherein the first side surface touches the wall surface of the interconnection pillar in the rear region and additionally in a part of the front region, as the contact portion touches the inner wall surface of the flange.

7. The slide fastener of claim 1, wherein the rear region of the first side surface includes a flat surface extending parallel to a longitudinal direction of said at least one fastener stringer.

8. The slide fastener of claim 1, wherein the interconnection pillar has a left and right wall surfaces that approach each other as extending toward a rear end of the interconnection pillar, the wall surface being touched by said at least part of the rear region of the first side surface.

9. The slide fastener of claim 1, wherein the upper protrusion has a sloped surface that touches a sloped surface facing forward and formed in a lower surface of an upper wing of the slider, and the lower protrusion has a sloped surface that touches a sloped surface facing forward and formed in an upper surface of a lower wing of the slider.

10. The slide fastener of claim 1, wherein a condition, in which the slider is pulled forward with a force equal to or greater than 66 Newtons and is prevented from moving forward by the front stop while the pair of fastener stringers are separate, can continue for a given duration of at least 10 seconds.

11. A slide fastener comprising:

a first fastener stringer including a first fastener tape, a first fastener element and a front stop, the first fastener element secured to a side edge of the first fastener tape;

a second fastener stringer including a second fastener tape and a second fastener element, the second fastener element secured to a side edge of the second fastener tape, the second fastener element engageable with the first fastener element; and a slider that moves forward and rearward to engage and disengage the first and second fastener elements, the slider including an upper wing, a lower wing, an interconnection pillar interconnecting the upper and lower wings, and at least a pair of flanges protruded at left and right side edges of the upper wing or the lower wing, the front stop including:

an insert inserted into the slider;

a stop portion with upper and lower protrusions respectively protruded upward and downward to touch the upper and lower wings so as to block forward movement of the slider;

a first side surface that faces the interconnection pillar as the front stop blocks forward movement of the slider, the first side surface including a rear region and a front region; and a second side surface that faces the flange as the front stop blocks forward movement of the slider, the second side surface positioned opposite to the first side surface, the second side surface including a rear region and a front region, wherein the front region of the second side surface is inclined or bulged away from the first side surface to form a predetermined angle with the rear region of the second side surface, and the front stop is oriented, when forward movement of the slider is blocked by the stop portion, to allow a contact portion included in the front region of the second side surface to touch an inner wall surface of the flange and to allow at least part of the rear region of the first side surface to touch a wall surface of the interconnection pillar.

12. The slide fastener of claim 11, wherein relative to a direction of movement of the slider, the front region of the second side surface is an inclined surface and the rear region of the second side surface is a flat surface.

13. The slide fastener of claim 11, wherein the front stop is in contact with the slider at least four separate upper, lower, left and right locations.

14. The slide fastener of claim 11, wherein the upper protrusion has first and second sloped surfaces that are in contact with the upper wing as forward movement of the slider is blocked by the stop portion, and the lower protrusion has third and fourth sloped surfaces that are in contact with the lower wing as forward movement of the slider is blocked by the stop portion, the first and second sloped surfaces being arranged to form a V-profile when viewed from above, and the third and fourth sloped surfaces being arranged to form a V-profile when viewed from below.

15. The slide fastener of claim 11, wherein a first distance between a first contact position between the contact portion and the inner wall surface of the flange and a second contact position between the part of the rear region of the first side surface and the wall surface of the interconnection pillar is less than a second distance between a front end of said flange with which the contact portion is in contact and said second contact position.

16. The slide fastener of claim 11, wherein the predetermined angle is in a range between 5° and 20°.

17. The slide fastener of claim 11, wherein the front stop is in contact with the flange and the interconnection pillar when forward movement of the slider is blocked by the stop portion, a contact portion included in the front region of the second side surface touching the inner wall surface of the flange and said at least part of the rear region of the first side surface touching the wall surface of the interconnection pillar.

* * * * *